US007047639B1

(12) United States Patent
Sheen

(10) Patent No.: US 7,047,639 B1
(45) Date of Patent: May 23, 2006

(54) METHOD FOR MANUFACTURING A HEAT-DISSIPATING STRUCTURE OF A RECTIFIER

(75) Inventor: Charng-Geng Sheen, Taoyuan (TW)

(73) Assignee: Actron Technology Corporation, Taoyuan (TW)

( * ) Notice: Subject to any disclaimer, the term of this patent is extended or adjusted under 35 U.S.C. 154(b) by 0 days.

(21) Appl. No.: 11/113,151

(22) Filed: Apr. 25, 2005

(51) Int. Cl.
*B23P 6/00* (2006.01)

(52) U.S. Cl. ..... 29/890.032; 29/890.036; 29/890.043; 29/890.045; 29/890.046; 29/890.047; 165/104.21; 165/104.26

(58) Field of Classification Search ..... 29/890.032, 29/890.036, 890.043, 890.045, 890.046, 29/890.047; 165/104.21, 104.26
See application file for complete search history.

(56) References Cited

U.S. PATENT DOCUMENTS

2005/0011633 A1* 1/2005 Garner et al. ..... 165/104.26
2005/0235494 A1* 10/2005 Chuang et al. ..... 29/890.032

* cited by examiner

*Primary Examiner*—Peter Vo
*Assistant Examiner*—Hung C. Le
(74) *Attorney, Agent, or Firm*—Rosenberg, Klein & Lee

(57) ABSTRACT

A method for manufacturing a heat-dissipating structure of a rectifier combines heat pipes into the heat-dissipating structure of the rectifier to enhance the heat-dissipating efficiency thereof. A metal tube of a heat pipe is has an inlet. A wick structure is formed inside the metal tube. The inlet of the metal tube is sealed. The metal tube is disposed in a mold of a heat-dissipating shell. A melted metal is cast into the mold and forms a heat-dissipating shell. The heat-dissipating shell is taken out from the mold. The sealed inlet of the metal tube in the heat-dissipating shell is cut. The metal tube is filled with a working fluid. The inlet of the metal tube is sealed.

6 Claims, 7 Drawing Sheets

METHOD FOR MANUFACTURING A HEAT-DISSIPATING STRUCTURE OF A RECTIFIER

BACKGROUND OF THE INVENTION

1. Field of the Invention

The present invention relates to a method for manufacturing a heat-dissipating structure of a rectifier, and particularly to a manufacturing method combining heat pipes in the heat-dissipating structure of a rectifier to enhance the heat-dissipating efficiency.

2. Description of the Prior Art

A generator, especially in an automobile, usually needs a rectifier to switch alternating current (AC) to direct current (DC), and then provides electric power for the automobile or charges a storage battery. Therefore, the stability of the rectifier greatly concerns the continuity of providing electric power. However, the temperature in the automobile engine is very high, and the rectifying diodes of the rectifier get hot after operating for a period of time. The two above-mentioned conditions may cause an irregular power supply. Therefore, the automotive generator needs a heat-dissipating structure for dissipating heat from the diodes.

Reference is made to FIG. 1, which is a heat-dissipating structure of a conventional rectifier. The heat-dissipating structure of the prior art has a cooling board 10*a*, a plurality of rectifying diodes embedded in the cooling board 10*a*, an insulated board 30*a* connected with the cooling board 10*a*, and a plurality of screwing bolts 40*a*. The cooling board 10*a* includes a plurality of fins 14*a* extending therefrom.

However, the conventional heat-dissipating structure of the rectifier only conducts heat via metal, so the efficiency of dissipating heat is still suboptimal. The thermal resistance is decided by the material conductivity and the effective area of volume. When the volume of the solid aluminum or copper heatsink reaches 0.006 stere (cubic meters), the thermal resistance cannot be reduced, even when the volume or area is enlarged. Besides, the conventional design must arrange the fins near the heat source, the rectifying diodes 20*a*, increasing not only manufacturing difficultly but also the total volume thereof. The generator therefore becomes bulky.

Although electronic devices use applied heat pipes to increase the heat-dissipating efficiency, heat pipes are still not used with the heat-dissipating structure of the rectifier. The reasons are that the shape of the rectifier is curved and complex because of the plural diodes spread on the rectifier, and the heat pipes are easily broken after bending. Therefore the heat pipes are not easily combined with the rectifier.

SUMMARY OF THE INVENTION

An object of the present invention is to provide a method for manufacturing a heat-dissipating structure of a rectifier that combines well the heat pipes in the heat-dissipating structure of the rectifier, and especially heat-dissipating structure covering the surface of the heat pipes fully, to enhance the heat-dissipating efficiency.

In order to achieve the above objects, the present invention provides a method for manufacturing a heat-dissipating structure of a rectifier, which comprises the following steps. A metal tube of a heat pipe is provided and the metal tube has an inlet. A wick structure is formed inside the metal tube. The inlet of the metal tube is sealed. The metal tube is disposed in a mold of a heat-dissipating shell. A melted metal is cast into the mold and forms a heat-dissipating shell.

The heat-dissipating shell is taken out from the mold. The sealed inlet of the metal tube in the heat-dissipating shell is cut. A working fluid is filled into the metal tube. The inlet of the metal tube is sealed.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF PREFERRED EMBODIMENTS

The present invention provides a method for combining well heat pipes into a heat-dissipating structure of a rectifier, thereby enhancing the efficiency of dissipating heat effectively. Specifically, insert molding is used to combine the heat pipes into the heat-dissipating structure of the rectifier and form a unique heat-dissipating structure. The key technology of the present invention resolves the problem of how the heat pipes are to endure a temperature of over 200 degrees centigrade during the casting process. Because the temperature of melted metal fluid greatly exceeds that temperature, a finished heat pipe has the potential to explode. The present invention resolves this problem as well.

Figure 1:
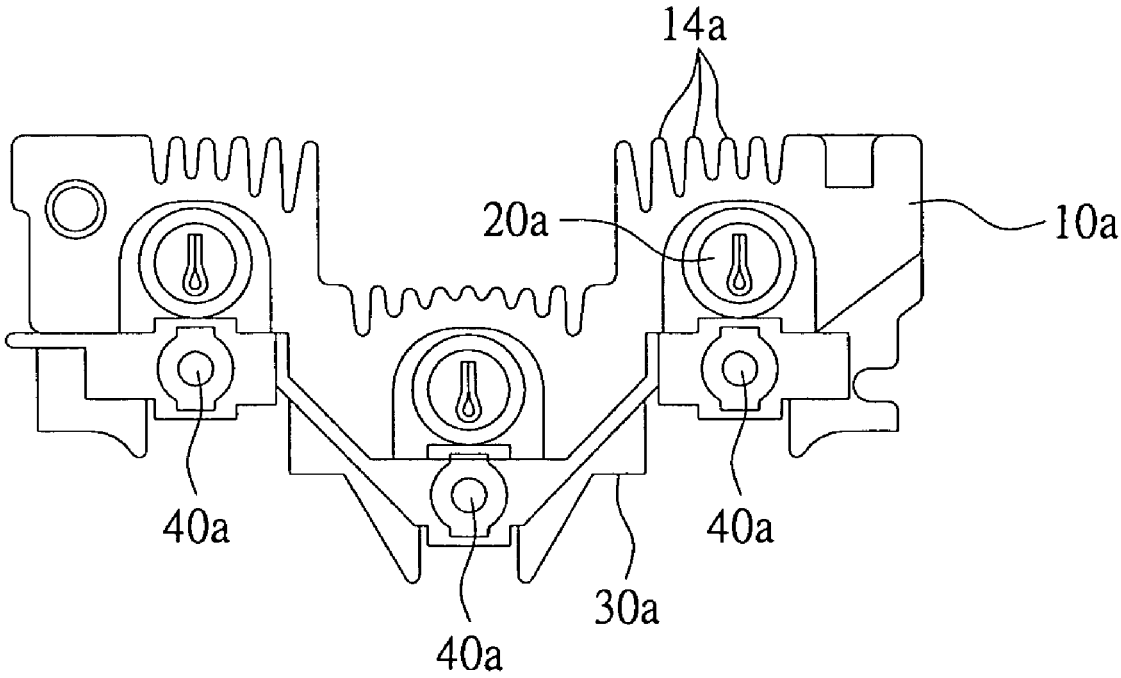
FIG 1 PRIOR ART
FIG. 1 is a top view of a heat-dissipating structure of a rectifier according to prior art.
Figure 2:
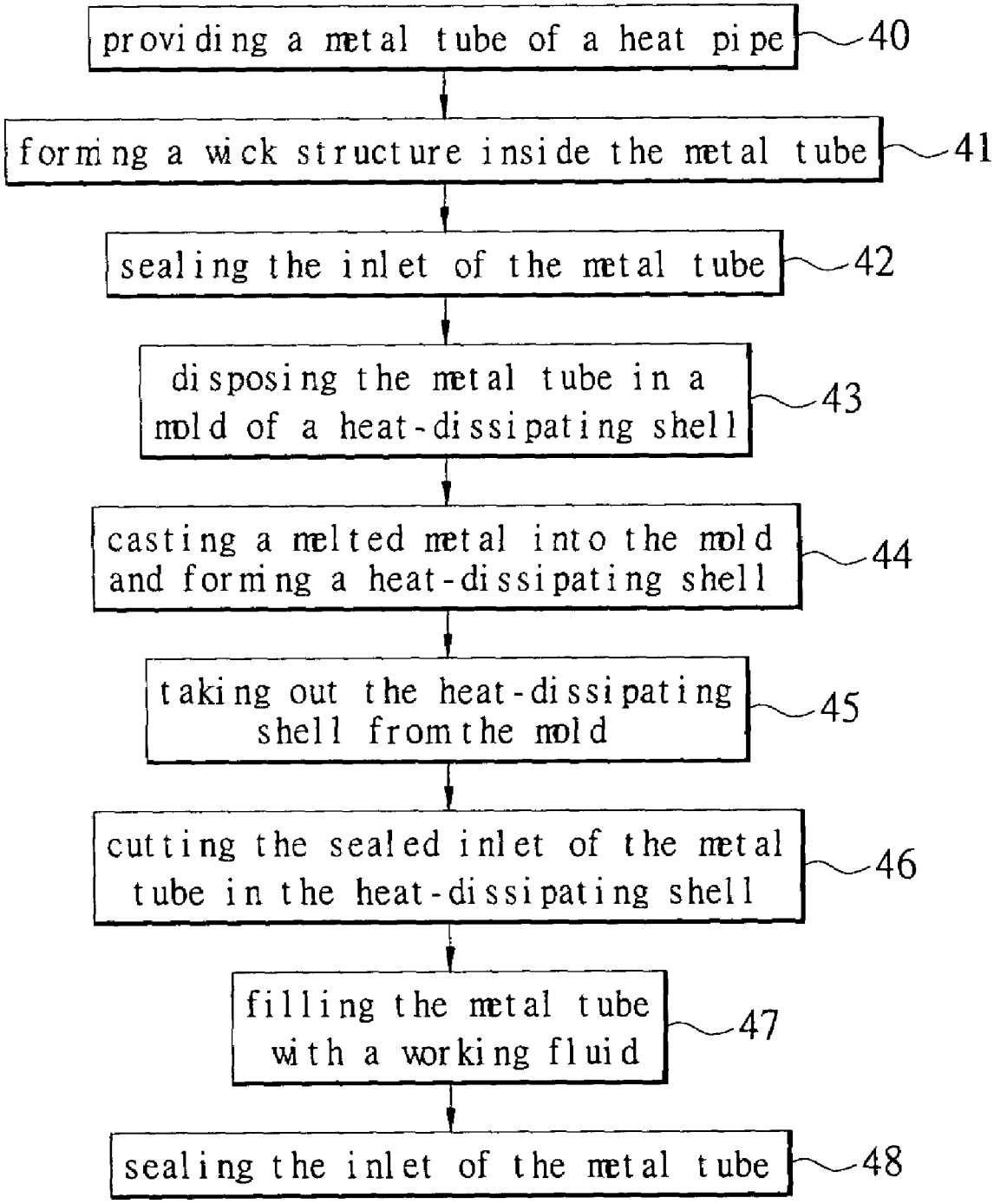
FIG. 2 is a flowchart of a method for manufacturing a heat-dissipating structure of a rectifier according to the present invention.

Reference is made to the FIG. 2, which is a flowchart of a method for manufacturing a heat-dissipating structure of a rectifier according to the present invention. The manufacturing method of the present invention includes the following steps.

First, as shown in step 40, a metal tube of a heat pipe is provided. The metal tube has two ends; one end is closed and the other is open and formed with an inlet. The material of the metal tube preferably is copper, but other materials can be used.

In step 41, a wick structure is formed inside the metal tube. A preferred method for making the wick structure is a sintering process, which sinters copper powders to form a porous sinter structure inside the metal tube. Alternatively, a metallic screen can be disposed inside the metal tube to form the wick structure, a plurality of capillary grooves can be formed on an inner surface of the metal tube to form the wick structure, or a plurality of copper fibers can be disposed on an inner surface of the metal tube to form the wick structure.

The step 42 of the present invention, the inlet of the metal tube is sealed temporarily and not filled with working fluid. The inlet is sealed for protecting the metal tube from pollution via other materials. The metal tube is not filled with working fluid and is thus a semi-finished heat pipe. Because no working fluid is heated, the metal tube will not expand and can endure high temperatures without danger of exploding. The metal tube and the wick structure preferably are made of copper.

Figure 3:
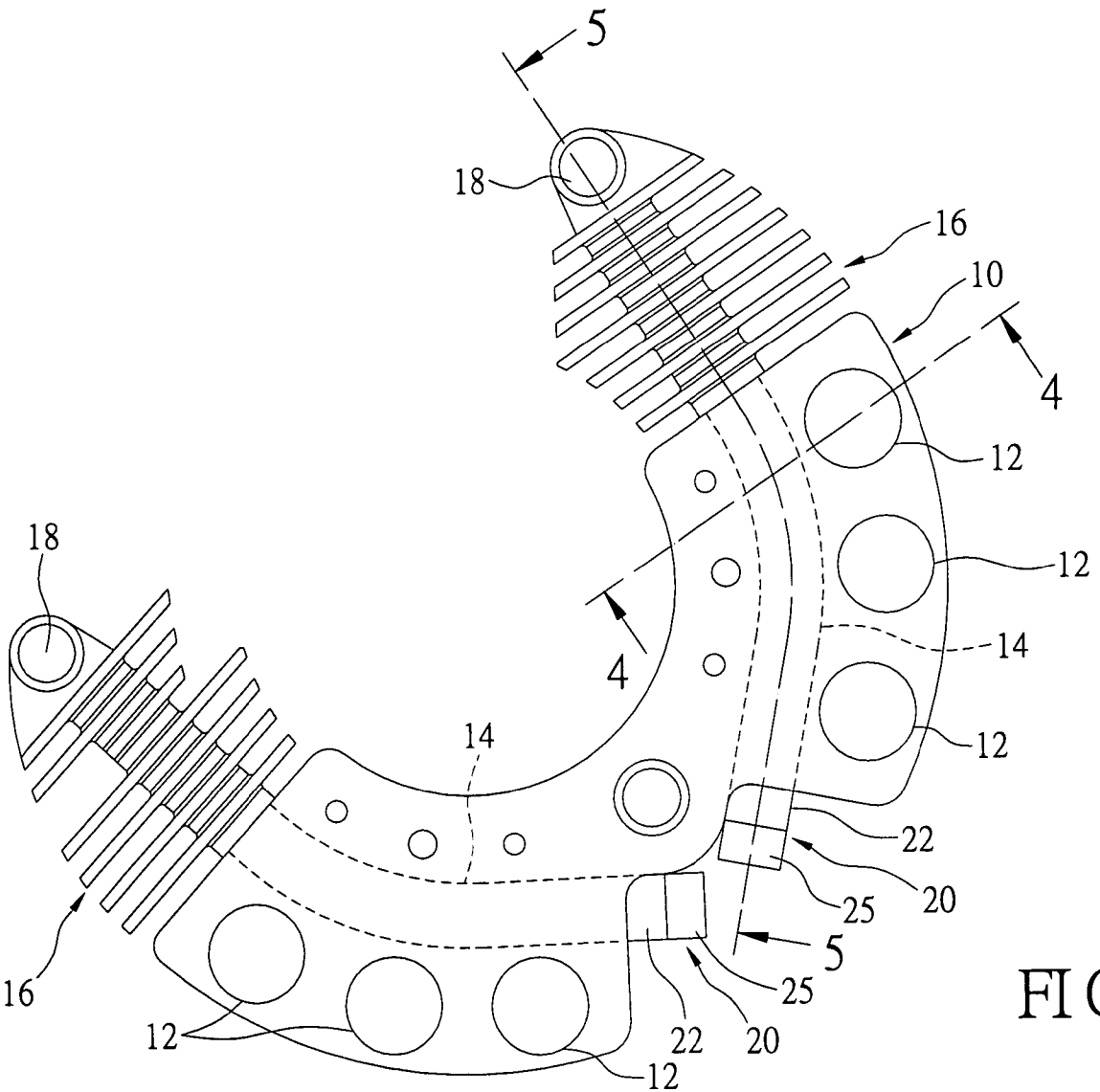
FIG. 3 is a top view of a heat-dissipating shell of a rectifier after casting according to the present invention.

In step 43, the metal tube is disposed in a mold of a heat-dissipating shell. Then, as shown in step 44, melted metal is cast into the mold to form the heat-dissipating shell. After cooling, the heat-dissipating shell is taken out from the mold, as shown in step 45. During the casting process, the metal tube is not filled with working fluid, so the metal tube can endure the high temperature without danger of exploding. The most important point is that the metal tube of the heat pipe closely united with the heat-dissipating shell. The finished product is shown in FIG. 3. FIG. 3 shows a heat-dissipating shell 10 formed with a semi-finished heat pipe 20, where the inlet 25 of the heat pipe 20 is sealed temporarily.

In step 46, the sealed inlet of the metal tube in the heat-dissipating shell is cut, the metal tube is evacuated, and the metal tube is filled with the working fluid, as shown in step 47. The working fluid can be water, or other fluid. Finally, the inlet of the metal tube is sealed, as shown in step 48, and the heat-dissipating structure of the rectifier of the present invention is finished.

Figure 4:
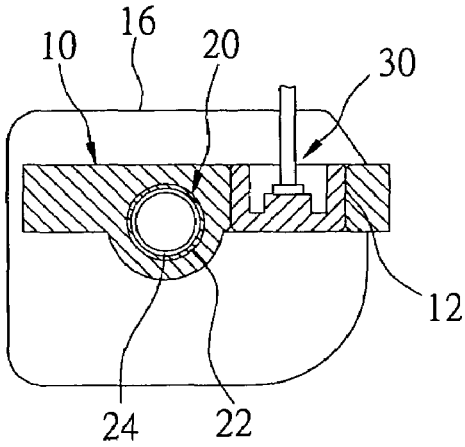
FIG. 4 is a cross-sectional view along line 4—4 in the FIG. 3 according to the present invention.
Figure 5:
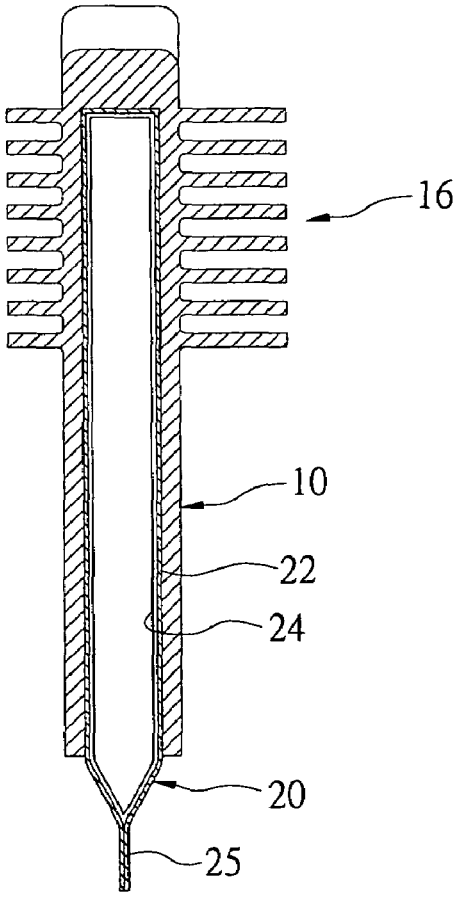
FIG. 5 is a cross-sectional view along line 5—5 in the FIG. 4 according to the present invention.

Reference is made to FIGS. 3 to 5, which are a top view of a heat-dissipating shell of a rectifier after cast according to the present invention, a cross-sectional view along line 4—4 in the FIG. 3, and a cross-sectional view along line 5—5 in the FIG. 4 according to the present invention, respectively. The present invention provides a heat-dissipating structure of a rectifier, which includes a heat-dissipating shell 10, and a plurality of heat pipes 20 embedded in the heat-dissipating shell 10. The heat-dissipating shell 10 is formed with a plurality of receiving cavities 12, heat pipe channels 14, a plurality of fins 16, and screwing holes 18. The receiving cavities 12 are used for receiving a plurality of rectifying diodes 30 (i.e. the heat sources), respectively. The metal tube 22 of the heat pipe 20 has two ends, and one end of the metal tube 22 is adjacent to the receiving cavities 12. In other words, one end of the heat pipe 20 is adjacent to the rectifying diodes 30. The fins 16 extend outwardly along an axis of the metal tube 22, and the fins 16 are formed adjacent to another end of the metal tube 22 for dissipating heat.

Figure 6:
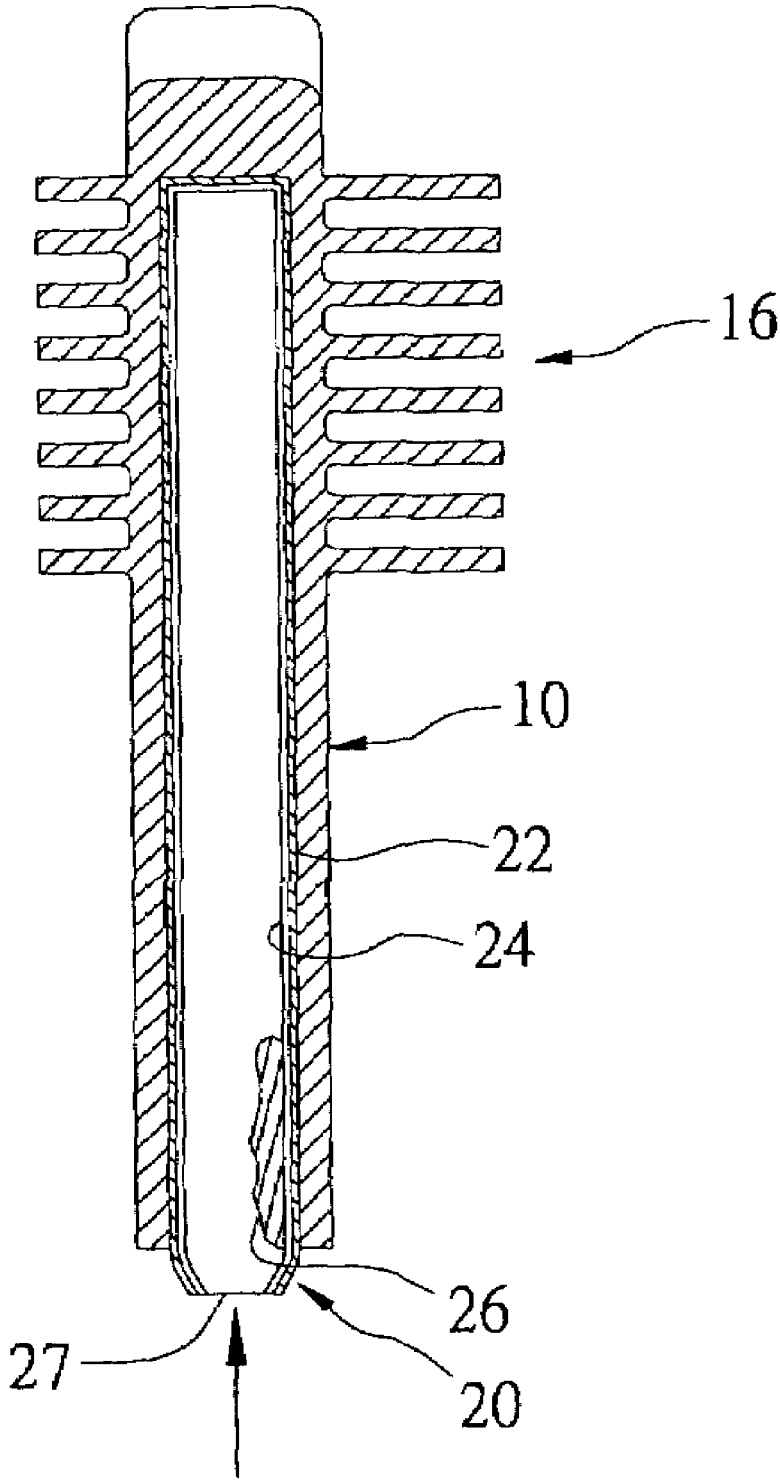
FIG. 6 is a cross-sectional view of a metal tube of the heat-dissipating shell filling with working fluid according to the present invention.
Figure 7:
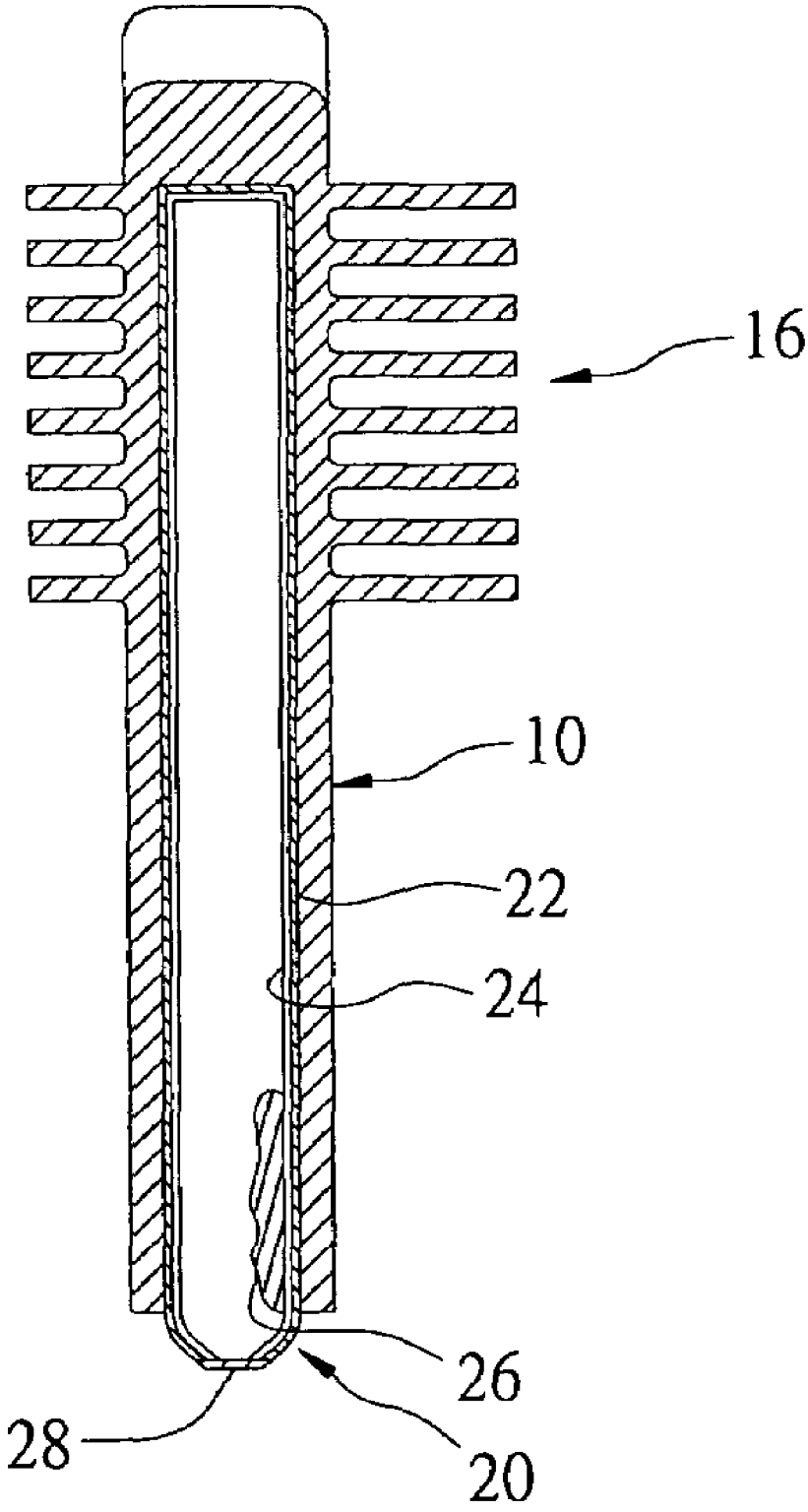
FIG. 7 is a cross-sectional view of sealing an inlet of the metal tube of the heat-dissipating shell according to the present invention.

Reference is made to FIG. 6, which illustrates steps 46 and 47 of the present invention. The inlet of the metal tube 22 in the heat-dissipating shell 10 is cut and forms an outlet 27. The metal tube 22 is filled with working fluid 26. Reference is made to FIG. 7, which shows step 48 of the present invention. The metal tube 22 is sealed and is formed with a seal portion 28, and finishes the heat-dissipating structure of the rectifier of the present invention. Then the rectifying diodes 30 can be embedded into the heat-dissipating structure of the rectifier.

Figure 8:
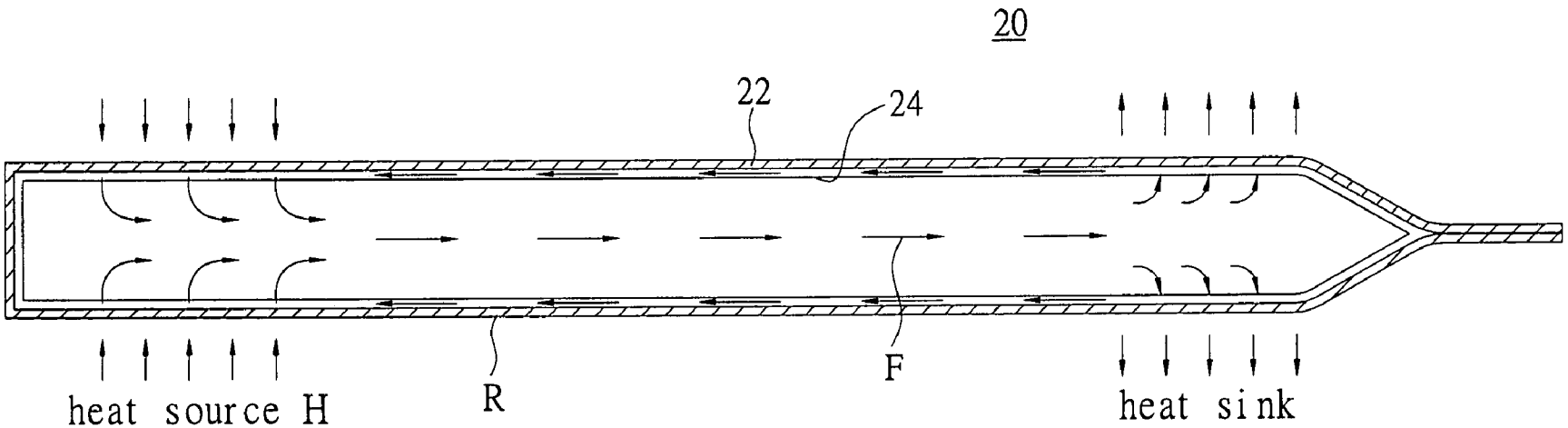
FIG. 8 is a cross-sectional view of the metal tube of the heat-dissipating shell according to the present invention.

Reference is made to FIG. 8, which is a cross-sectional view of the metal tube of the heat-dissipating shell according to the present invention. The heat pipe 20 includes a closed container (the metal tube 22), the wick structure 24, and the working fluid F. According to the operating principle, the heat pipe 20 is divided into three sections: (a) an evaporator section; (b) an adiabatic section; and (c) a condenser section.

The operating principle of the heat pipe 20 is describes as followed. When one end (evaporator section) of the heat pipe touch a heat source H, the working fluid F in the heat pipe 20 will absorb vaporization latent heat and become vapor. Because the vapor pressure of the evaporator section is higher than that the other end of the heat pipe (condenser section), a pressure difference is formed between the two ends and drives the vapor from the evaporator section in to the condenser section. The vapor is cooled by the surroundings via the metal tube and releases the latent heat, and the conduction mission is finished. The vapor becomes liquid, which is wicked by wicking force or gravity through the wick structure and returned to the evaporator section, and an operating cycle is finished. Therefore, the wicking force of the wick structure is larger than the total pressure difference in the heat pipe, and the heat pipe can work normally.

A summary of the characteristics and advantages of the present invention are as follows:

The present invention provides a method for manufacturing a heat-dissipating structure of a rectifier, in which the heat pipe enhances heat dissipating and conducting efficiencies in a natural cooling environment, which raises heat-dissipating performance several times higher than that of the prior art, to enhance the heat-dissipating efficiency.

Although the present invention has been described with reference to the preferred embodiments thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A method for manufacturing a heat-dissipating structure of a rectifier, comprising the steps of:

providing a metal tube of a heat pipe, said metal tube having an inlet;

forming a wick structure inside said metal tube;

sealing said inlet of said metal tube;

disposing said metal tube in a mold of a heat-dissipating shell;

casting a melted metal into said mold and forming a heat-dissipating shell;

taking out said heat-dissipating shell from the mold;

cutting said sealed inlet of said metal tube in said heat-dissipating shell;

filling said metal tube with a working fluid; and sealing said inlet of said metal tube.

2. The method for manufacturing a heat-dissipating structure of a rectifier as claimed in claim 1, wherein said metal tube and said wick structure are made of copper.

3. The method for manufacturing a heat-dissipating structure of a rectifier as claimed in claim 1, wherein said working fluid is water.

4. The method for manufacturing a heat-dissipating structure of a rectifier as claimed in claim 1, wherein said heat-dissipating shell is formed with a plurality of receiving cavities for receiving a plurality of rectifying diodes, respectively, said metal tube has two ends, and one end of said metal tube is adjacent to said receiving cavities.

5. The method for manufacturing a heat-dissipating structure of a rectifier as claimed in claim 4, wherein said heat-dissipating shell includes a plurality of fins extending outwardly along an axis of said metal tube, and said fins are formed adjacent to another end of said metal tube.

6. The method for manufacturing a heat-dissipating structure of a rectifier as claimed in claim 1, further comprising a step of vacuuming air in said metal tube before filling said metal tube with said working fluid.

* * * * *